US006491572B1

(12) United States Patent
Horie et al.

(10) Patent No.: US 6,491,572 B1
(45) Date of Patent: Dec. 10, 2002

(54) METHOD OF PROCESSING SURFACE OF GLASS SUBSTRATE FOR MAGNETIC DISK AND SUSPENSION WITH ABRASIVE PARTICLES THEREFOR

(75) Inventors: Yuji Horie, Tokyo (JP); Takabumi Marukawa, Tokyo (JP); Yoshihiro Tawara, Tokyo (JP); Kanichi Endo, Tokyo (JP)

(73) Assignee: Nihon Microcoating Co., Ltd., Tokyo (JP)

( * ) Notice: Subject to any disclaimer, the term of this patent is extended or adjusted under 35 U.S.C. 154(b) by 54 days.

(21) Appl. No.: 09/686,921

(22) Filed: Oct. 10, 2000

(30) Foreign Application Priority Data

Mar. 29, 2000 (JP) ..... 2000-132954
May 24, 2000 (JP) ..... 2000-191829

(51) Int. Cl.[7] ..... B24B 1/00
(52) U.S. Cl. ..... 451/63; 451/41; 451/59
(58) Field of Search ..... 451/36, 41, 59, 451/53, 63, 61; 252/79.5, 279.1; 610/175, 395, 397, 435

(56) References Cited

U.S. PATENT DOCUMENTS 3,685,218 A * 8/1972 Gambale et al. ..... 51/283
5,580,667 A * 12/1996 Lal et al. ..... 428/610
5,645,471 A * 7/1997 Strecker ..... 451/59
5,899,794 A * 5/1999 Shige et al. ..... 451/59 X
6,042,455 A * 3/2000 Togawa et al. ..... 451/59 X
6,120,361 A * 9/2000 Konishi et al. ..... 451/287
6,155,914 A * 12/2000 Reynen et al. ..... 451/63 X
6,315,638 B1 * 11/2001 Marukawa ..... 451/36

* cited by examiner

*Primary Examiner*—Joseph J. Hail, III
*Assistant Examiner*—Anthony Ojini
(74) *Attorney, Agent, or Firm*—Beyer Weaver & Thomas LLP

(57) ABSTRACT

A glass substrate for a magnetic disk has one or both of its surfaces processed by applying a suspension of a specified kind onto the surface to be processed while the substrate is rotated and a polishing tape is pressed and run against the surface to be processed. The suspension includes abrasive particles with average diameter selected according to the purpose of the processing and an aqueous solution containing a reacting liquid capable of causing a solid phase reaction at contact boundary surfaces between the surface of the glass substrate and these abrasive particles. The polishing tape is removed from the glass substrate when the polishing is over but while the tape is still running and the glass substrate is rotating. The supplying of the suspension is thereafter stopped and a washing liquid such as water is applied to the polished surface or surfaces while the substrate is still rotating. Both surfaces of a glass substrate may be polished at the same time.

16 Claims, 4 Drawing Sheets

METHOD OF PROCESSING SURFACE OF GLASS SUBSTRATE FOR MAGNETIC DISK AND SUSPENSION WITH ABRASIVE PARTICLES THEREFOR

BACKGROUND OF THE INVENTION

This invention relates to a method of processing a glass substrate for a magnetic disk to a desired degree of roughness and also to a suspension with abrasive particles for such processing.

A substrate for a magnetic disk has its surface mirror-polished and then subjected to a texturing process such that the magnetic disk will be provided with magnetic non-isotropy to improve its magnetic characteristic as a magnetic memory medium and that the adsorption between the magnetic head and the surface of the magnetic disk can be prevented when the hard disk drive is not operating. A magnetic layer is formed thereabove, say, by sputtering. As a substrate for such a magnetic disk, use is usually made of a so-called aluminum substrate with a disk made of an aluminum and plated with Ni—P. Such an aluminum substrate is mirror-polished, as disclosed in Japanese Patent Publication Tokkai 8-96355, by sandwiching it between urethane foam pads impregnated with free abrasive particles while a polishing liquid such as an aqueous solution of a surfactant is supplied, and a texturing process is thereafter carried out by pressing a polishing tape of a non-woven cloth material or the like against it while a suspension having abrasive particles suspended in a dispersing liquid mainly of water is supplied.

Glass substrates are recently coming to be used for producing magnetic disks. A glass substrate, too, is required to have its surface processed to be smooth and flat and textured. The surface of a glass surface, however, is different from that of an aluminum substrate comprising an Ni—P plated membrane, being hard and fragile. If the same process used on aluminum substrates were carried out on a glass substrate, therefore, there would be formed unwanted protrusions and irregular scratches and it is not possible to accurately obtain a surface with desired roughness (including a smooth and flat surface). In particular, there is the problem that uniform and fine textured lines cannot be formed.

SUMMARY OF THE INVENTION

It is therefore an object of this invention to provide a method by which one or both of the surfaces of a glass substrate for a magnetic disk can be processed to a desired level of roughness and in particular uniform and fine textured lines can be formed thereon without any unwanted protrusions or irregular scratches, as well as a suspension with abrasive particles which may be used for such a process.

It is also an object of this invention to provide glass substrates for a magnetic disk with one or both surfaces processed by such a method.

A method embodying this invention for surface-processing a glass substrate for a magnetic disk, with which the above and other objects can be accomplished, may be characterized as comprising the steps of rotating the glass substrate, and causing an abrasive tape selected according to the purpose of surface polishing to be pressed and to run against it, while supplying a suspension with abrasive particles to its surface.

A suspension with abrasive particles embodying this invention may be characterized as comprising abrasive particles having diameters selected according to the purpose of the processing and an aqueous solution containing a reacting liquid capable of causing a solid phase reaction on the contacting surface between these abrasive particles and the surface of a glass substrate.

As described above, a glass substrate for a magnetic disk has its surface of surfaces polished according to this invention by rotating it and causing an abrasive tape selected according to the purpose of the surface polishing to be pressed and to run against it, while supplying a suspension which contains abrasive particles and a reacting liquid to the surface being abraded. The average diameter of the abrasive particles in the suspension is determined according to the purpose of the surface processing. As for the reacting liquid capable of causing a solid phase reaction on the contacting surface between these abrasive particles and the surface of the glass substrate, an aqueous solution containing hydroxyl group and having etching capability on a glass material is used such as solutions containing ammonium salts such as tetramethyl ammonium hydroxide. Neutral and alkaline suspensions may be used but neutral ones are preferable in view of environmental problems associated with the disposal of used liquids.

When a suspension with abrasive particles according to this invention is applied to the surface of a glass substrate, a solid phase reaction takes place on the contact boundary surfaces between the abrasive particles and the glass substrate surface and a heterogeneous substance such as a glass hydrate is generated chemically. The glass hydrate thus generated is mechanically removed from the substrate surface by the abrasive particles during the course of the polishing process. Thus, the substrate surface is polished according to this invention by a chemical-mechanical polishing process and hence the polishing is effected in units of very small areas, or the target surface is polished extremely finely. The method is advantageous also because it relies upon a chemical reaction and hence the deterioration due to the processing is negligibly small.

Polishing tapes capable of collecting polished-off debris generated during the polishing process into its interior are preferably to be used. Examples of such a polishing tape include polishing tapes with a layer of foam material on the surface of a plastic tape, woven and non-woven cloth tapes comprising plastic fibers and planted tapes having plastic fibers planted into the surface of a plastic tape. In the case of a tape with a layer of foam material, debris particles are collected into the foams exposed on the surface of the layer of foam material. In the case of a woven or non-woven cloth tape or a planted tape, they are taken into the space between the fibers and removed from the surface of the glass substrate as trapped inside the polishing tape.

There are two objectives to the polishing, one being for flattening so as to improve the smoothness and evenness of the surface and the other being the so-called texturing process for forming concentric textured lines on the surface. In the former, the surface roughness is reduced by the polishing process but since the surface roughness cannot be reduced to zero as a practical matter, the kind of smooth and flat surfaces obtainable by a process embodying this invention will also be referred to as a "rough surface".

The surface roughness of such glass substrates is controlled by a combination of the type of polishing tape and the diameters of the abrasive particles in the suspension. For example, if a woven or non-woven tape or a planted tape comprising plastic fibers is used as the polishing tape, textured lines without unwanted protrusions or irregular scratches can be formed. If abrasive particles with relatively large diameters are used in such a case, the surface roughness becomes larger. If abrasive particles with relatively small diameters are used, the surface roughness becomes smaller. A flat surface processing can be effected by using a polishing tape of the kind having an elastic layer of a foam material on the surface of a plastic tape. As in the case of a texturing process, the surface roughness can be made smaller by using abrasive particles with smaller diameters.

After the surface of a glass surface is polished as above, the polishing tape which has been running is removed from the substrate surface, the supply of the suspension with abrasive particles is stopped and a washing liquid such as water is applied to the substrate surface to clean it while the substrate is kept rotating. While the polishing tape is pressed and run and the glass substrate is kept rotating, a large amount of the suspension remains near the contact area between the polishing tape and the substrate. Thus, if the polishing tape were removed from the substrate surface after the rotary motion of the glass substrate and the movement of the polishing tape are stopped, a glass hydrate would be formed chemically as explained above on the contact boundary surface between the abrasive particles in the suspension remaining near the contact area between the polishing tape and the substrate surface, forming local protrusions of this glass hydrate on the surface of the glass substrate. Such protrusions would not be removable from the surface of the glass substrate by merely applying a washing liquid thereon. In other words, unwanted protrusions would be formed as a result. According to the present invention, therefore, the polishing tape is removed from the surface of the glass substrate, the supply of the suspension with abrasive particles is stopped and a washing liquid such as water is applied while the substrate is kept rotating such that the centrifugal force due to the rotary motion of the substrate can be taken advantage of to remove the abraded particles and the leftover suspension liquid still remaining on the surface of the substrate can be removed therefrom.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
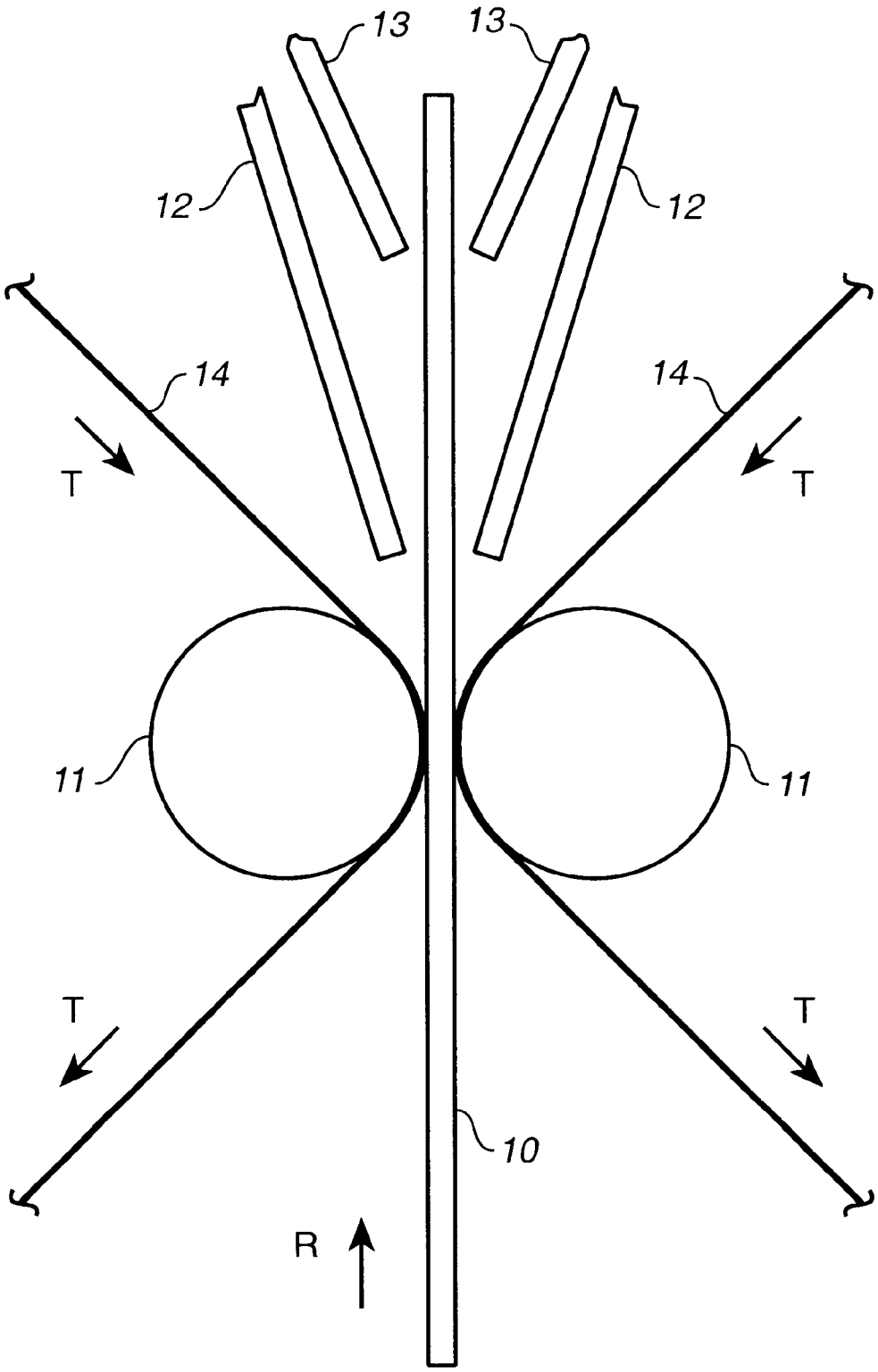
FIG. 1 is a schematic drawing of a polishing machine for using a method of polishing embodying this invention.

FIG. 1 shows a polishing machine for polishing both surfaces of a substrate by a method embodying this invention but a machine for polishing only one surface (not shown) may be used according to this invention.

With reference now to FIG. 1, a glass substrate 10 is rotated in the direction indicated by arrow R. A suspension containing abrasive particles is applied to both surfaces of this substrate 10 through a pair of nozzles 12. Polishing tapes 14 are pressed against both surfaces of the substrate 10 and moved in the directions shown by arrows T to polish them. The suspension may be first applied to the polishing tapes 14 and then supplied indirectly through the polishing tapes 14 onto the surfaces of the glass substrate 10 or may be directly applied to the positions on the substrate surfaces where the polishing tapes 14 are adapted to come into contact.

The suspension is comprised of abrasive particles with diameters selected according to the purpose of the polishing and an aqueous solution containing a reacting liquid capable of causing a solid phase reaction on the contact boundary surface between these abrasive particles and the surface of the glass substrate 10. As for the reacting liquid capable of causing a solid phase reaction on the contact surface, an aqueous solution containing hydroxyl group and having etching capability on a glass material is used such as solutions containing ammonium salts such as tetramethyl ammonium hydroxide.

The polishing tapes 14 may be pulled out through rollers (not shown) of a known type, pressed against the surfaces of the glass substrate 10 by means of contact rollers 11 and wound up around take-up rollers (not shown) in a known manner. When the polishing process is carried out for the purpose of producing smooth and flat surfaces, it has been known (as disclosed in Japanese Patent Publication Tokkai 11-151651) to make use of foam tapes produced by forming a foam layer, for example, of urethane foam with thickness 0.1–1 mm and hardness 10–90 on the surface of a plastic tape of a material such as polyethylene terephthalate with high resistance against tensile stress and chemicals. When textured lines are to be formed on a glass substrate, on the other hand, use may be made of a woven or non-woven cloth tape with thickness 5–3000 $\mu$m comprising plastic fibers such as nylon or polyester fibers of thickness 0.05–5 denier or a planted tape with plastic fibers such as nylon fibers of length 0.05–0.5 mm planted on the surface of a plastic tape such as a polyester tape. Abrasive particles of diamond, aluminum oxide, zirconium oxide, cerium oxide, magnesium oxide, chromium oxide, silicon carbide and boron nitride with average diameter in the range of 0.01–10 $\mu$m may be appropriately selected.

After the surfaces of the glass substrate 10 have been polished as described above, the polishing tapes 14 being run as indicated by arrows T are removed away from the surfaces of the glass substrate 10 while the glass substrate 10 is kept rotating as schematically indicated by arrow R, the supply of the suspension is stopped and a washing liquid such as water is supplied through nozzles 13 onto the surfaces of the glass substrate 10 to remove debris particles and leftover suspension liquid therefrom.

The invention is described next by way of real tests carried out by using a polishing machine as described above with reference to FIG. 1. In Test 1, both surfaces of a glass substrate were polished to be smooth and flat. Tests 2 and 3 were each carried out to form textured lines on both surfaces of a glass substrate. The average surface roughness Ra and the maximum surface roughness Ry of each glass substrate before and after the polishing process were measured by means of a scanning probe microscope (Nanoscope Dimension 3100 Series produced by Digital Instrument, Inc.) and by scanning a randomly selected test area of 30 μm ×30 μm (at 256 points).

Test 1

Polishing tapes made by forming a polyurethane foam layer of thickness 500 μm and hardness 60 on the surface of a polyester tape with thickness 25 μm were used together with a suspension with composition as shown in Table 1. Both surfaces of a glass substrate were polished under the conditions shown in Table 2. The average surface roughness and the maximum surface roughness of the glass substrate were respectively 4.10 Å and 156.20 Å before the surface polishing. They were respectively 2.20 Å and 75.40 Å after the polishing.

TABLE 1

| Composition of the suspension used in Test 1 | |
|---|---|
| Diamond particles (average diameter = 0.100 μm): | 10 weight % |
| Pure water | 85 weight % |
| Tetramethyl ammonium hydroxide | 5 weight % |

TABLE 2

| Conditions of polishing in Test 1 | |
|---|---|
| Speed of substrate rotation | 200 rpm |
| Linear speed of polishing tapes | 10 cm/minute |
| Pressure by contact roller (inside) | 2.0 kg |
| Pressure by contact roller (outside) | 1.5 kg |
| Supply rate of suspension | 10 milli-liter/minute |
| Time duration of polishing | 15 seconds |
| Washing liquid | Water |

Test 2

Woven cloth tapes comprising polyester fibers of thickness 0.06 denier were used as polishing tapes together with a suspension with composition as shown in Table 3. Both surfaces of a glass substrate were polished under the same conditions as in Test 1 (as shown in Table 2). The average surface roughness and the maximum surface roughness of the glass substrate were respectively 4.10 Å and 156.20 Å before the surface polishing. They were respectively 5.79 Å and 72.20 Å after the polishing.

TABLE 3

| Composition of the suspension used in Test 2 | |
|---|---|
| Diamond particles (average diameter = 0.125 μm): | 10 weight % |
| Pure water | 85 weight % |
| Tetramethyl ammonium hydroxide | 5 weight % |

Test 3

Planted tapes each formed by planting nylon fibers of thickness 1.0 denier and length 0.1 mm onto the surface of a polyester tape of thickness 75 μm were used as polishing tapes together with a suspension with composition as shown in Table 4. Both surfaces of a glass substrate were polished under the same conditions as in Test 1 (as shown in Table 2). The average surface roughness and the maximum surface roughness of the glass substrate were respectively 4.10 Å and 156.20 Å before the surface polishing. They were respectively 9.60 Å and 93.86 Å after the polishing.

TABLE 4

| Composition of the suspension used in Test 3 | |
|---|---|
| Diamond particles (average diameter = 0.150 μm): | 10 weight % |
| Pure water | 85 weight % |
| Tetramethyl ammonium hydroxide | 5 weight % |

Results of Tests 1, 2 and 3 are shown in Table 5.

TABLE 5

| | Size of abrasive particles | Tape type | Ra | Ry |
|---|---|---|---|---|
| Before | | | 4.10 Å | 156.20 Å |
| Test 1 | 0.100 μm | Foam | 2.20 Å | 75.40 Å |
| Test 2 | 0.125 μm | Woven cloth | 5.80 Å | 72.20 Å |
| Test 3 | 0.150 μm | Planted | 9.60 Å | 93.86 Å |

Figure 2:
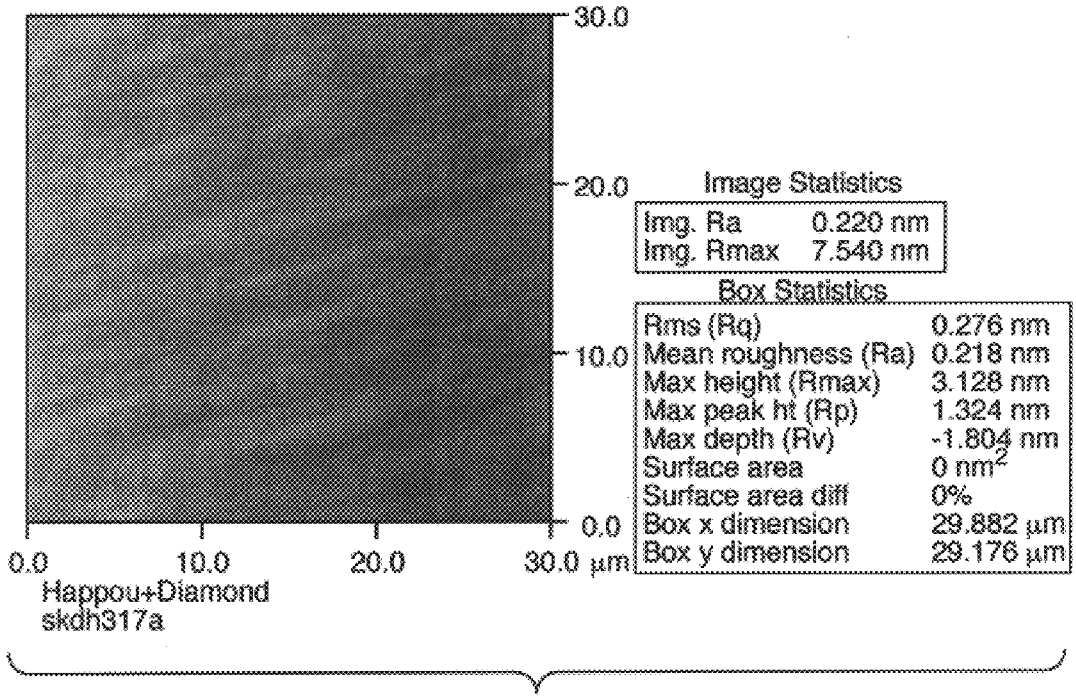
FIG. 2 is an enlarged photograph showing a plan view of a portion of a surface of a glass substrate polished in Test 1 described below.
Figure 3:
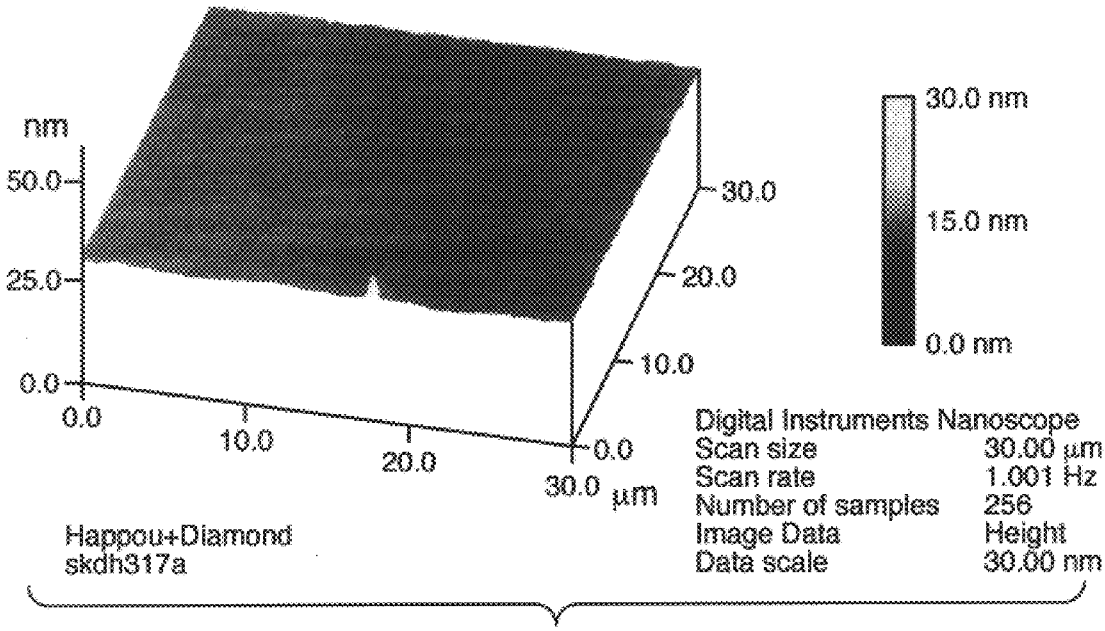
FIG. 3 is an enlarged photograph showing a diagonal view of a portion of a surface of a glass substrate polished in Test 1 described below.
Figure 4:
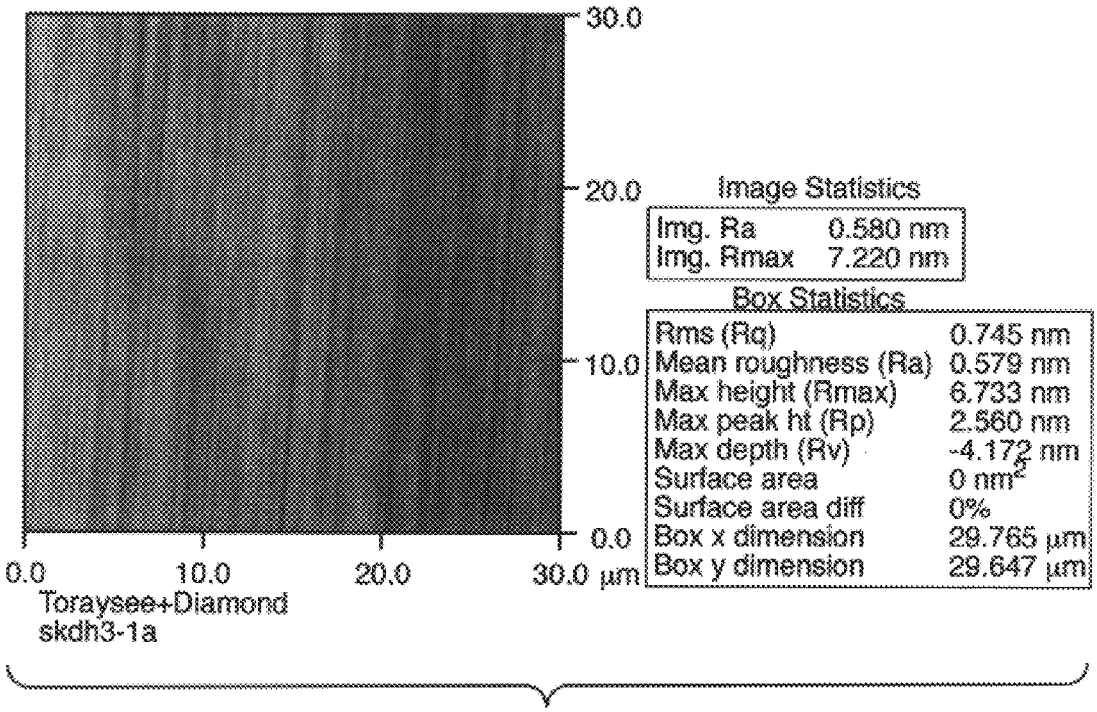
FIG. 4 is an enlarged photograph showing a plan view of a portion of a surface of a glass substrate polished in Test 2 described below.
Figure 5:
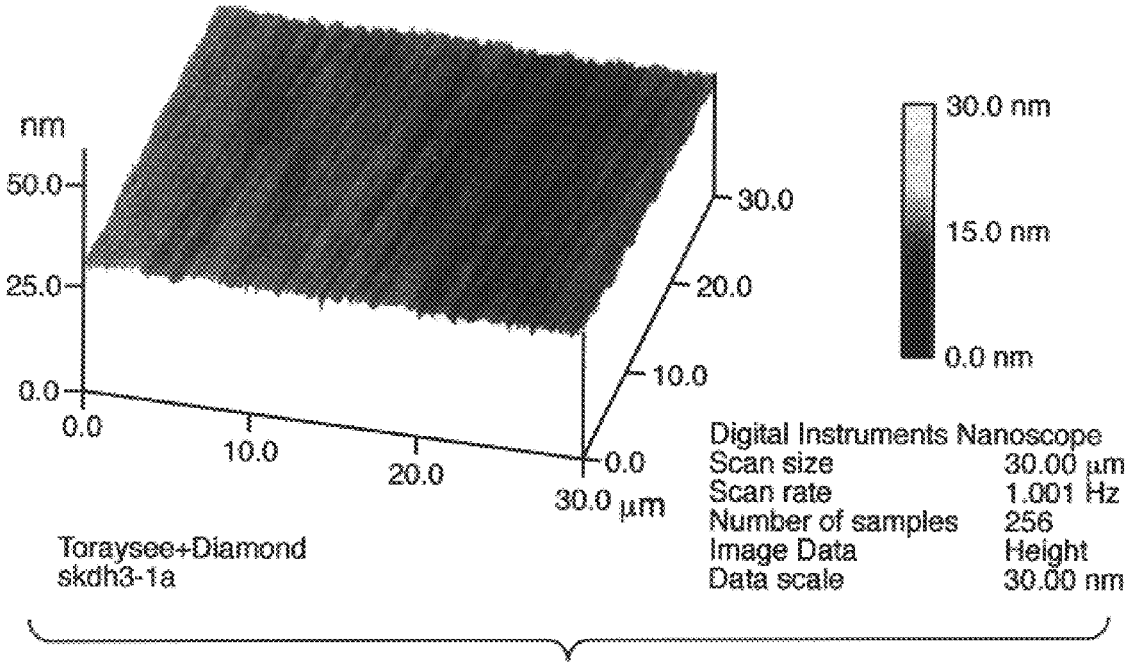
FIG. 5 is an enlarged photograph showing a diagonal view of a portion of a surface of a glass substrate polished in Test 2 described below.
Figure 6:
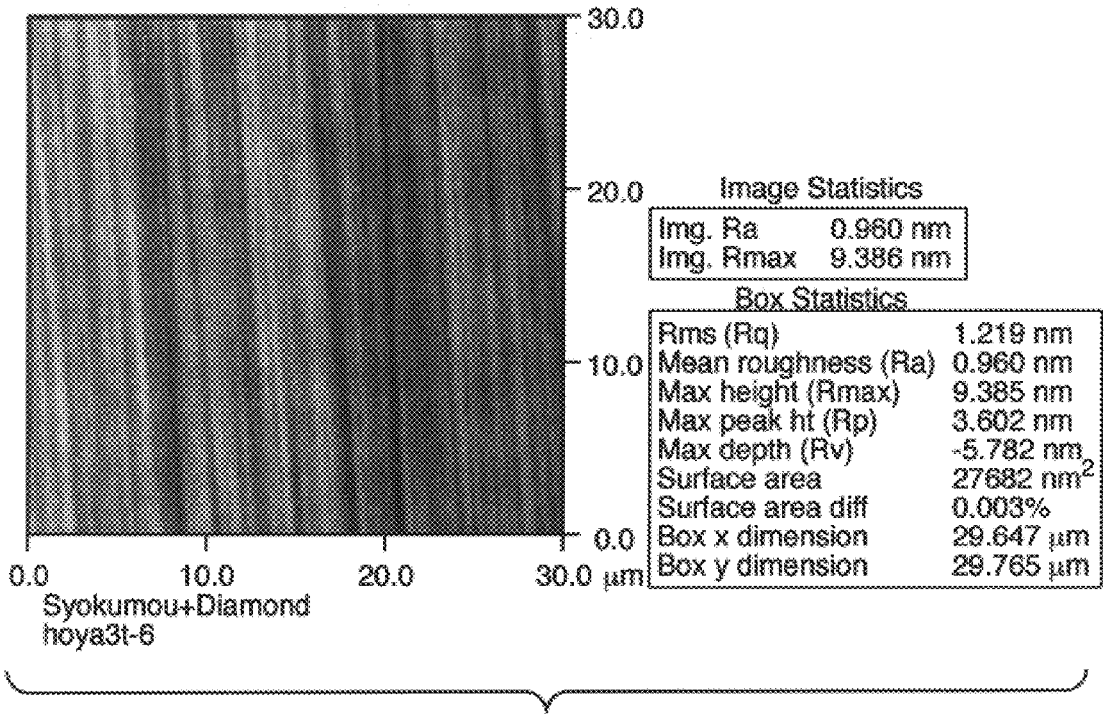
FIG. 6 is an enlarged photograph showing a plan view of a portion of a surface of a glass substrate polished in Test 3 described below.
Figure 7:
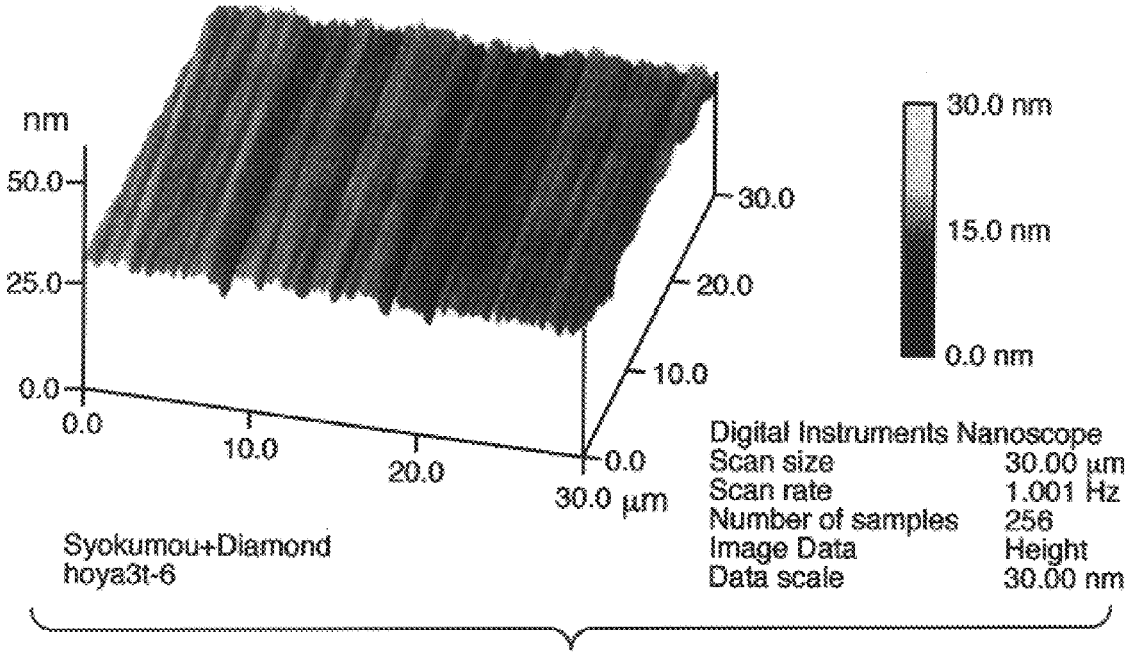
FIG. 7 is an enlarged photograph showing a diagonal view of a portion of a surface of a glass substrate polished in Test 3 described below.

In Test 1, use was made of a combination of abrasive particles with average diameter 0.1 μm and foam tapes to obtain smooth and flat surfaces without any abnormal protrusions, as shown by the enlarged photographs in FIGS. 2 and 3. In Tests 2 and 3, the combination used was of abrasive particles with average diameter 0.1 μm and respectively a woven tape and a planted tape. As shown in the photographs in FIGS. 4–7, it was possible to obtain a surface with textured lines formed thereon without any unwanted protrusions or scratches. They also show that narrower textured lines can be formed uniformly if abrasive particles with a smaller average diameter are used.

Test 4

On the surface of each of the glass substrates polished according to a method of this invention (Tests 2 and 3), a CoNiCr/Cr layer with thickness 1100 Å was formed as a magnetic layer by a known sputtering method. Thereafter, a protective C layer with thickness 300 Å was formed on each to produce magnetic disks (Disks 1 and 2). For the purpose of comparison, two additional magnetic disks (Disks 1' and 2' ) were prepared. The glass substrates used for the preparation of Disks 1' and 2' were the same as those for Disks 1 and 2, polished by using the same polishing tape with a polyurethane foam layer as used in Test 1 and a suspension with the same composition as shown in Table 1 except that the abrasive particles were diamond particles with average diameters respectively 0.125 μm and 0.150 μm and under the same conditions shown in Table 2.

Magnetic non-isotropy of these magnetic disks were studied. The ratio between the magnetic coercive force of a magnetic disk in its peripheral direction and that in its radial direction is referred to as its orientation ratio (OR). If OR is greater than 1, it means that t h e magnetic disk has a magnetic non-isotropy in its circumferential direction. Table 6 shows the relationship between the magnetic non-isotropy (in terms of OR) and the average surface roughness Ra of these disks.

TABLE 6

| | Presence/Absence of textured lines | Ra (Å) | OR |
|---|---|---|---|
| Disk 1 | Present | 5.80 | 1.06 |
| Disk 2 | Present | 9.60 | 1.17 |
| Disk 1' | Absent | 5.80 | 1.00 |
| Disk 2' | Absent | 9.60 | 1.00 |

Table 6 shows that those of the magnetic disks using a glass substrate on which were formed textured lines according to this invention show a magnetic non-isotropy in the circumferential direction but those using a glass substrate which has been mirror-polished (and having no textured lines) have no magnetic non-isotropy.

In summary, the surface of a hard but fragile glass substrate can be polished to a desired level of roughness by a proper choice of the average diameter of the abrasive particles to be used in the suspension and the type of the polishing tape for the surface polishing. In addition, the present invention has the merit wherein fine and uniform textured lines without any unwanted protrusions or irregular scratches can be provided to either one or both of a glass substrate.

What is claimed is:

1. A suspension for processing a surface of a glass substrate for a magnetic disk, said suspension comprising:

abrasive particles with average diameter selected according to purposes of the processing; and an aqueous solution containing ammonium salt and a reacting liquid, said reacting liquid having hydroxyl groups and a characteristic of etching glass and causing a solid phase reaction at contact boundary surfaces between said surface of said glass substrate and said abrasive particles.

2. The suspension of claim 1 wherein said ammonium slat is tetramethyl ammonium hydroxide.

3. A method of processing a surface of a glass substrate for a magnetic disk, said method comprising the steps of:

rotating said glass substrate;

supplying a suspension onto the surface of said glass substrate, said suspension comprising abrasive particles with average diameter selected according to purposes of the processing; and an aqueous solution containing a reacting liquid which causes a solid phase reaction at contact boundary surfaces between said surface of said glass substrate and said abrasive particles;

pressing and running a polishing tape selected according to the purposes of the processing against the surface of said glass substrate to thereby polish said surface;

removing said polishing tape from the surface of said glass substrate while said tape is still running and said glass substrate is rotating; and stopping supplying said suspension and supplying a washing liquid onto said surface of said glass substrate while said glass substrate is rotating.

4. The method of claim 3 wherein said reacting liquid has hydroxyl groups and a characteristic of etching glass.

5. The method of claim 4 wherein said aqueous solution comprises ammonium salt.

6. The suspension of claim 5 wherein said ammonium salt is tetramethyl ammonium hydroxide.

7. The method of claim 6 wherein said polishing tape comprises a plastic tape having a foam layer on a surface thereof.

8. The method of claim 6 wherein said polishing tape is one selected from the group consisting of a woven cloth tape comprising plastic fibers, a non-woven cloth tape comprising plastic fibers and a planted tape having plastic fibers planted onto a surface of a plastic tape.

9. The method of claim 5 wherein said polishing tape comprises a plastic tape having a foam layer on a surface thereof.

10. The method of claim 5 wherein said polishing tape is one selected from the group consisting of a woven cloth tape comprising plastic fibers, a non-woven cloth tape comprising plastic fibers and a planted tape having plastic fibers planted onto a surface of a plastic tape.

11. The method of claim 4 wherein said polishing tape comprises a plastic tape having a foam layer on a surface thereof.

12. The method of claim 4 wherein said polishing tape is one selected from the group consisting of a woven cloth tape comprising plastic fibers, a non-woven cloth tape comprising plastic fibers and a planted tape having plastic fibers planted onto a surface of a plastic tape.

13. The method of claim 3 wherein said polishing tape comprises a plastic tape having a foam layer on a surface thereof.

14. The method of claim 3 wherein said polishing tape is one selected from the group consisting of a woven cloth tape comprising plastic fibers, a non-woven cloth tape comprising plastic fibers and a planted tape having plastic fibers planted onto a surface of a plastic tape.

15. A glass substrate for a magnetic disk, said glass substrate having at least one surface which has textured lines formed thereon by a method comprising the steps of:

rotating said glass substrate;

supplying a suspension onto the surface of said glass substrate, said suspension comprising abrasive particles with average diameter selected according to purpose of the processing; and an aqueous solution containing a reacting liquid which causes a solid phase reaction at contact boundary surfaces between said surface of said glass substrate and said abrasive particles;

pressing and running a polishing tape selected according to a purpose of the processing against the surface of said glass substrate to thereby polish said surface;

removing said polishing tape from the surface of said glass substrate while said tape is still running and said glass substrate is rotating; and stopping supplying said suspension and supplying a washing liquid onto said surface of said glass substrate while said glass substrate is rotating.

16. The glass substrate of claim 15 wherein said polishing tape is one selected from the group consisting of a woven cloth tape comprising plastic fibers, a non-woven cloth tape comprising plastic fibers and a planted tape having plastic fibers planted onto a surface of a plastic tape.

* * * * *